United States Patent [19]

Korger

[11] 3,961,801

[45] June 8, 1976

[54] HEEL-HOLDING DEVICE FOR SKI BINDINGS

[75] Inventor: Heinz Korger, Munich, Germany

[73] Assignee: Hannes Marker, Garmisch-Partenkirchen, Germany

[22] Filed: Feb. 5, 1975

[21] Appl. No.: 547,336

[30] Foreign Application Priority Data

Feb. 20, 1974 Germany ..... 2408159

[52] U.S. Cl. ..... 280/626

[51] Int. Cl.[2] ..... A63C 9/08

[58] Field of Search ..... 280/11.35 T

[56] References Cited

UNITED STATES PATENTS

| | | | |
|---|---|---|---|
| 3,620,545 | 11/1971 | Korger | 280/11.35 T |
| 3,754,770 | 8/1973 | Suhner | 280/11.35 T |
| 3,768,822 | 10/1973 | Kanno | 280/11.35 T |
| 3,830,510 | 8/1974 | Stauffer | 280/11.35 T |

*Primary Examiner*—Robert R. Song
*Attorney, Agent, or Firm*—Fleit & Jacobson

[57] ABSTRACT

In a heel-holding device for ski bindings in which a sole depressor equipped with a closing pedal is pivoted to the ski about a horizontal transverse shaft disposed behind the boot and is resiliently pressed onto the upper sole rim by a spring, the force of the spring being transmitted to the sole depressor by an interposed locking member which is pivoted to the ski parallel to the sole depressor, and in which the locking member is deliberately pivotable to a depressor-releasing position by means of a handle so that the sole depressor can assume its open position under the influence of a second spring that is weaker than the first spring, the transverse shaft of the locking member is disposed on the boot side of the transverse shaft of the sole depressor and the locking member is provided with a recess for receiving a latch member of the sole depressor, the recess being formed with a slide track and adjoining catch groove co-operating with the latch member.

4 Claims, 4 Drawing Figures

HEEL-HOLDING DEVICE FOR SKI BINDINGS

The present invention relates to a heel-holding device for ski bindings in which a sole depressor equipped with a closing pedal is pivoted to the ski about a horizontal transverse shaft disposed behind the boot and is resiliently pressed onto the upper sole rim by a spring, the force of the spring being transmitted to the sole depressor by an interposed locking member which is pivoted to the ski parallel to the sole depressor, and in which the locking member is deliberately pivotable to a depressor-releasing position by means of a handle so that the sole depressor can assume its open position under the influence of a second spring that is weaker than the first spring.

When an excessive load is applied to the sole depressor, a known such heel-holding device is released in an upward direction away from the ski so as to release the rim of the sole of the ski boot. The known heel-holding device comprises a relatively large housing which carries the sole depressor at its front end and, in a longitudinal hole that is slightly inclined to the horizontal, receives the spring and a piston through which the spring presses on the locking member. A screw plug fixed to the housing forms the counterbearing for the spring and permits adjustment of the spring bias for the purpose of varying the releasing force of the heel-holding device. The locking member is provided with two supporting surfaces against which the piston and a control extension of the sole depressor rest in opposite directions. The arrangement is such that the locking member possesses two stable limiting positions corresponding to the operative and open positions of the sole depressor. The limiting open position is variable through a large range of elasticity in that the sole depressor is automatically adaptable to differently thick soles. This is an important advantage of the heel-holding device in question over other known heel-holding devices that are still conventional.

A disadvantage of the above-described known heel-holding device is, however, its size as necessitated by its construction, and consequently its large weight and manufacturing costs.

The object of the present invention is therefore to provide a heel-holding device of the aforementioned kind which is more compact, lighter in weight and consequently can be made more simply and cheaply.

In a heel-holding device for ski bindings in which a sole depressor equipped with a closing pedal is pivoted to the ski about a horizontal transverse shaft disposed behind the boot and is resiliently pressed onto the upper sole rim by a spring, the force of the spring being transmitted to the sole depressor by an interposed locking member which is pivoted to the ski parallel to the sole depressor, and in which the locking member is deliberately pivotable to a depressor-releasing position by means of a handle so that the sole depressor can assume its open position under the influence of a second spring that is weaker than the first spring, the present invention provides for the transverse shaft of the locking member to be disposed on the boot side of the transverse shaft of the sole depressor, whilst the locking member is provided with a recess for receiving a latch member of the sole depressor, the recess being formed with a slide track and adjoining catch groove co-operating with the latch member.

In one form of the invention, the locking member forms one lever of a four-bar linkage, of which the second lever serves as the handle for deliberate opening, and the pivot connection to the locking member of the coupling interconnecting the two levers forms the point at which the force of the first spring is applied. The handle is preferably mounted coaxially with the sole depressor.

Apart from conventional ski bindings consisting of a heel-holding device and a toe-holding device in the form of a so called front jaw, an increasing number of plate bindings is being marketed, that is to say bindings in which the boot is no longer in direct contact with the safety devices. In such bindings, the boot is held on the plate at both ends and can only be deliberately released therefrom. The hitherto known heel and toe-holding devices must be adapted to the respective sole thickness of the boots.

To avoid this, in the same way as with the previously-described heel-holding devices equipped with safety release means, it is proposed that in a heel or toe-holding device which is fixed to the plate and which, in accordance with the principal feature of the invention, has the transverse shaft of the locking member disposed on the boot side of the transverse shaft of the sole depressor whilst the locking member is provided with a recess for receiving a latch member of the sole depressor, the recess being formed with a slide track and adjoining catch groove co-operating with the latch member, a locking lug should be provided between the slide track and catch groove. The locking lug prevents unintentional entry of the latch member of the sole depressor in the catch groove and thereby opening of the sole depressor even when an appropriately large force is applied thereto.

Heel-holding devices constructed in accordance with the invention will now be described in more detail with reference to the examples shown in the accompanying drawings, wherein.

Figure 1:
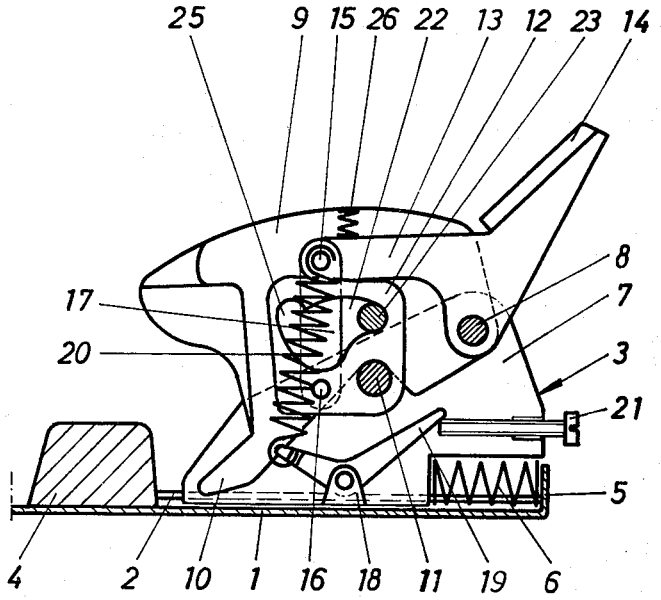
FIG. 1 is a central longitudinal section of a heel-holding device which is equipped with safety release means and is shown in its lowermost operative limiting position.
Figure 2:
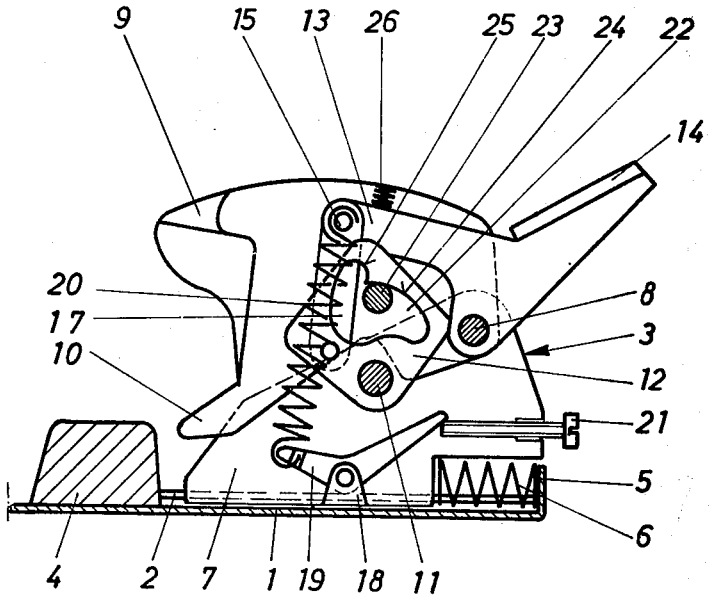
FIG. 2 is a corresponding view showing the heel-holding device in its uppermost limiting operative position.
Figure 3:
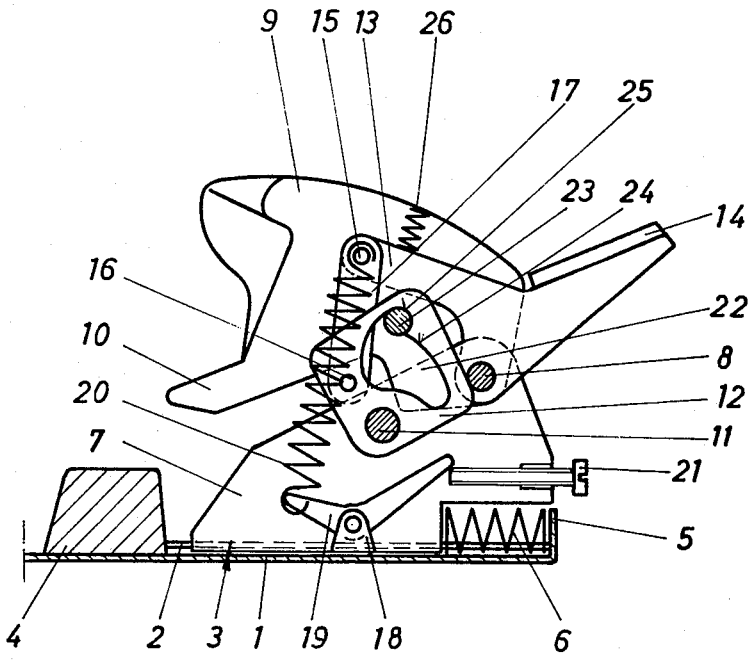
FIG. 3 is a corresponding view showing the heel-holding device in its open position.

Referring to FIGS. 1 to 3, the heel-holding device comprises a base plate 1 which can be screwed onto a ski (not shown). The longitudinal edges of the base plate are, as is usual, formed as guide rails 2 for a slide 3. At the left hand end of the base plate as viewed in the drawings, the base plate is provided with a tread 4 or ribs on which the heel of the boot is supported. The rear end (right hand end as viewed in the drawings) of the base plate is flanged upwardly to form an abutment 5 for a spring 6 which presses on the slide 3 and, in known manner, applies the force that is necessary for longitudinally resiliently holding the boot between the heel-holding device and a suitable front jaw.

Mounted in two longitudinal side walls 7 of the slide 3 there is a horizontal transverse shaft 8 on which a sole depressor 9 is in turn pivotally mounted. A closing pedal 10 is formed on the sole depressor. A second shaft 11 is mounted parallel to the shaft 8 in the longitudinal side walls 7 of the slide 3 and a locking member 12 is in turn pivotally mounted on the shaft 11. This locking member forms one lever of a four-bar linkage of which the second lever 13 is likewise mounted on the shaft 8 between the bearing points of the sole depressor 9. The lever 13 has two arms, its second arm 14 serving as a handle for deliberately opening the heel-holding device. The coupling 17 of the four-bar linkage is connected to the free end of the lever 13 and to the locking member 12 by means of respective pivot pins 15, 16.

Beneath the locking member 12 a bearing member 18 for an angular lever 19 is provided in the slide 3. A tension spring 20 engages one arm of this angular lever, the other end of the spring being suspended from the pivot pin 15. The other arm of the angular lever rests against a set screw 21 by means of which the position of the angular lever in the slide and thus the bias of the tension spring 20 are adjustable.

The locking member 12 is provided with a recess 22 which is traversed by a cylindrical latch member 23 which is provided in the sole depressor 9 parallel to the shafts 8 and 11. For the purpose of co-operating with this latch member, the recess forms a slide track 24 and a catch groove 25 that adjoins the slide track at the left hand end of the latter as viewed in the drawings. By means of the tension spring 20 acting through the coupling 17 and the locking member 12, the latch member 23 is held in constant engagement with the slide track 24. In addition, a weak helical compression spring 26 is provided between the lever 13 and the sole depressor 9 for biassing the sole depressor in the opening direction.

FIG. 1 shows the heel-holding device with the sole depressor 9 in its operative position for holding a boot to the ski. If a force is now exerted from the boot on the sole depressor in a sense tending to turn the sole depressor in a clockwise direction about the shaft 8, the tension spring 20 is stressed through the latch member 23, locking member 12 and coupling 17. If the force is sufficiently large and prolonged, the sole depressor is pivoted from the FIG. 1 position to that shown in FIG. 2. If the force on the sole depressor then diminishes, the latter returns to its starting position under the influence of the tension spring 20. However, if the force is continued to be applied, the latch member 23 leaves the slide track 24 and enters the catch groove 25, the compression spring 26 being correspondingly relieved. The four-bar linkage will now assume a self-locking position as shown in FIG. 3.

On introducing a boot in the binding, the heel strikes the closing pedal 10 and the sole depressor 9 is pivoted counterclockwise about the shaft 8 against the small force of the compression spring 26 until the latch member 23 leaves the catch groove 25 and thereby releases the self-locking action of the four-bar linkage. The force of the tension spring 20 is now free to continue to turn the sole depressor 9 and resiliently press same onto the upper rim of the sole.

For deliberately opening the heel-holding device for the purpose of intentionally releasing the boot from the ski, the handle 14 is swung clockwise about the shaft 8, for example by means of a ski stick. The lever 13 thereby carries the locking member 12 with it through the coupling 17, whereby the latch member 23 is released from the slide track 24. This pivotal movement is effected against the force of the springs 20 and 26. When the handle 14 has been depressed, not only can the ski boot be lifted off without effort but the compression spring 26 will also act on the sole depressor 9 in the opening direction. After the handle 14 has been released, the heel-holding device will again assume its open position as shown in FIG. 3.

The sole depressor 9 will automatically adapt to different sole thicknesses within predetermined limits. This takes place by utilising the available large range of elasticity. FIG. 1 shows the sole depressor in its lowermost limiting operative position and FIG. 2 in its uppermost limiting operative position. In both these positions and in all intermediate positions the force of the tension spring 20 is transmitted to the sole depressor 9 so that the latter is resiliently pressed on the upper rim of the sole.

Figure 4:
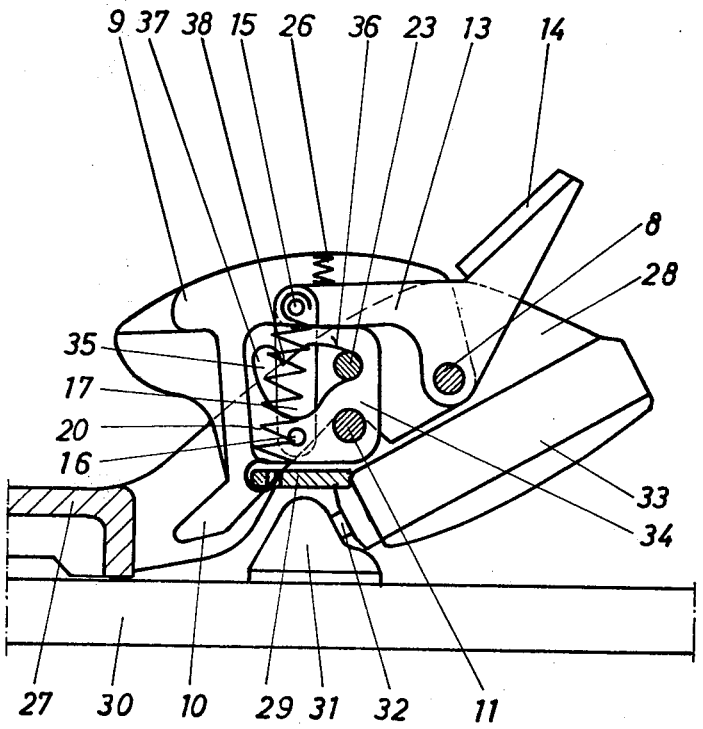
FIG. 4 is a central longitudinal section through a heel-holding device that is not equipped with safety release means and that is shown in its lowermost limiting operative position.

FIG. 4 shows a heel-holding device according to the invention which is not provided with safety release means. Several of the components in the FIG. 4 construction are identical with those described in relation to FIGS. 1 to 3 and are therefore provided with the same reference numerals. Instead of the aforementioned slide, the FIG. 4 construction possesses a sole plate 27 which is itself releasable from the ski when a correspondingly large force is applied. The boot can only be deliberately released from the plate. The heel-holding device is accommodated between two side walls 28 provided at the rear end of the plate. The following components of the FIGS. 1 to 3 construction are also provided in FIG. 4, namely, shaft 8, sole depressor 9, closing pedal 10, shaft 11, lever 13, handle 14, pivot pins 15, 16, coupling 17, tension spring 20, latch member 23 and helical compression spring 26.

The tension spring 20 is in the present case suspended from a cross-member 29 extending between the two side walls 28. Below this cross-member the ski 30 is provided with a stop carrier 31 in which a member 32 of a stop device accommodated in the housing 33 is engaged. The housing is fixed to the plate 27 through the side walls 28.

In the present case there is likewise a locking member 34 which is only slightly different from the locking member 12. It is likewise provided with a recess 35 forming a slide track 36 and a catch groove 37 for the latch member 23. Whereas in the case of the locking member 12 the catch groove 25 was directly adjacent the slide track 24, a locking lug 38 is now provided between the slide track and catch groove. This locking lug prevents unintentional entry of the latch member 23 in the catch groove 37. The latch member can enter the catch groove only when the handle 14 is actuated. For this purpose the stop lug is curved about the shaft 11 at the portion adjoining the slide track 36. The open position of the sole depressor practically corresponds to that of FIG. 3. The automatic snap closure of the sole depressor takes place in the same manner when a boot is introduced in the binding. In the present embodiment there is likewise automatic adaptation of the sole depressor to different sole thicknesses.

For the purpose of describing the FIG. 4 embodiment, a plate binding was chosen having a heel-holding device without safety release means. This was done only because depression of the heel end of the sole is more conventional and simpler than depressing the toe end of the sole. It is, however, to be understood that the sole plate could be provided with a toe-holding device which exhibits the features of the present invention. In that case the sole plate may exhibit a non-releasable heel-holding device.

I claim:

1. A heel-holding device for ski bindings comprising, in combination, a first transverse shaft mounted on the ski behind the boot, a sole depressor having a closing pedal mounted on said first transverse shaft for pivotal movement onto the upper sole rim of the boot and into a released position, a second transverse shaft mounted on the ski between the boot and said first transverse shaft, a locking member mounted on said second transverse shaft for pivotal movement parallel to said sole depressor between a sole depressor retaining position and a sole depressor releasing position, a first spring for urging said sole depressor through said locking member into a yieldingly clamping position onto the upper sole rim of the boot, a handle pivotally mounted on the ski for pivotally moving said locking member into said sole depressor releasing position, a second spring weaker than said first spring for urging said sole depressor into said released position, a latch member on said sole depressor, said locking member having a recess for receiving said latch member, said locking member recess having a slide track for sliding engagement with said latch member in the boot sole rim engaging position of said sole depressor and a catch groove adjacent said slide track for locking engagement with said latch member in the released position of said sole depressor.

2. A heel-holding device in accordance with claim 1 including a coupling pivotally connected at one end to said handle and pivotally connected at the other end to said locking member, the force of said first spring being applied to said coupling other end at the pivotal connection with said locking member and wherein said locking member and said handle form first and second levers respectively of a four-bar linkage.

3. A heel-holding device in accordance with claim 1 wherein said handle is pivotally mounted on said first transverse shaft co-axially with said sole depressor.

4. A heel-holding device in accordance with claim 1 including a locking lug in said locking member recess between said slide track and said catch groove.

* * * * *